United States Patent [19]

Fillmore et al.

[11] 4,057,159

[45] Nov. 8, 1977

[54] VAPOR-SEAL SAFETY CAP AND CONTAINER

[75] Inventors: William E. Fillmore, Toledo; Wayne E. Garver, Sylvania; George V. Mumford, Toledo; James H. Price, Maumee, all of Ohio

[73] Assignee: Owens-Illinois, Inc., Toledo, Ohio

[21] Appl. No.: 733,690

[22] Filed: Oct. 18, 1976

[51] Int. Cl.[2] ..... B65D 55/02; B65D 85/56; A61J 1/00

[52] U.S. Cl. ..... 215/222; 215/347; 215/348

[58] Field of Search ..... 215/222, 347, 348

[56] References Cited

U.S. PATENT DOCUMENTS

| | | | |
|---|---|---|---|
| 3,896,959 | 7/1975 | Roy | 215/222 |
| 3,931,891 | 1/1976 | Peppler | 215/222 X |

*Primary Examiner*—George T. Hall
*Attorney, Agent, or Firm*—A. J. Steger; E. J. Holler

[57] ABSTRACT

An improved vapor-seal, child-resistant closure and container combination is disclosed herein. The container comprises a cylindrical plastic body which is molded in one piece and has circumferentially spaced, radially extending projections on the upper end thereof that have notches therein. The closure comprises a one-piece plastic body having a top panel and an annular depending skirt with circumferentially spaced lugs extending radially inwardly for engagement with the notches. An annular integral rim or abutment is provided on the annular surface of the top panel of the closure and depends downwardly therefrom. A unique two-piece, vapor-seal liner is interposed between the annular abutment and the lugs for engagement with the upper end of the container. The two-piece liner incorporates a resilient disk member which serves as a spring between the closure and container and a deformable disk positioned beneath the resilient disk which may be pressed into sealing engagement with the upper rim of the container to provide a vapor-tight seal between the closure and container.

6 Claims, 3 Drawing Figures

VAPOR-SEAL SAFETY CAP AND CONTAINER

BACKGROUND OF THE INVENTION

This invention relates to child-resistant closures and containers. More specifically, this invention relates to a child-resistant closure and container combination which incorporates an improved vapor-sealing liner system.

A serious problem that has long existed with respect to the handling of drugs is that drugs are often packaged in containers that can be readily opened by children, resulting in many serious injuries or deaths. A variety of child-resistant safety closures have been introduced, such as the safety cap and container discussed in the patent to Hedgewich, U.S. Pat. No. 3,344,942,issued Oct. 3, 1967. The problem with this safety closure and many others is that its construction provides no means for preventing moisture vapor from penetrating through to the contents of the container. It has been found that exposure to moisture vapor can be very destructive to various types of medicines.

Various attempts have been made to incorporate a vapor seal into a safety closure, such as, for example, those concepts taught by the patents to Hedgewich et al, U.S. Pat. Nos. 3,478,911 issued Nov. 18, 1969, and Hedgewick et al, 3,485,403 issued Dec. 23, 1969. However, it has been found that the sealing liners suggested by the aforementioned Hedgewick patents have not been sufficiently resilient and deformable to withstand repeated opening and reapplication of the closure to the container. Thus, the vapor-sealing effectiveness of such construction has diminished with continued use of these devices over a period of time.

SUMMARY OF THE INVENTION

It is, therefore, an object of this invention to provide an improved vapor-sealing, child-resistant closure and container combination.

Generally, the container comprises a cylindrical plastic body which has circumferentially spaced, radially extending projections on the upper end thereof, that have notches therein. The child-resistant closure of this invention comprises a one-piece plastic body having a top panel and a depending annular skirt with circumferentially spaced lugs extending radially inwardly for engagement with the notches. An annular integral ring or abutment is provided on the inside surface of the top panel. A unique liner system, formed from two separate disks of material, is interposed between the annular abutment and the lugs for engagement with the upper rim of the container. The upper layer of the two-piece liner system is formed from a disk of flexible, resilient material which forms a spring member between the closure and container. The lower layer is formed from a highly deformable material, so that it may be placed into sealing engagement with the upper rim of the container to provide a vapor seal between the closure and container when the closure is applied into locking engagement with the container.

Other objects, features and advantages of this invention will become apparent to one skilled in the art upon reference to the following detailed description of the invention and the drawings illustrating the invention.

IN THE DRAWINGS

DETAILED DESCRIPTIONS OF THE PREFERRED EMBODIMENTS

Figure 1:
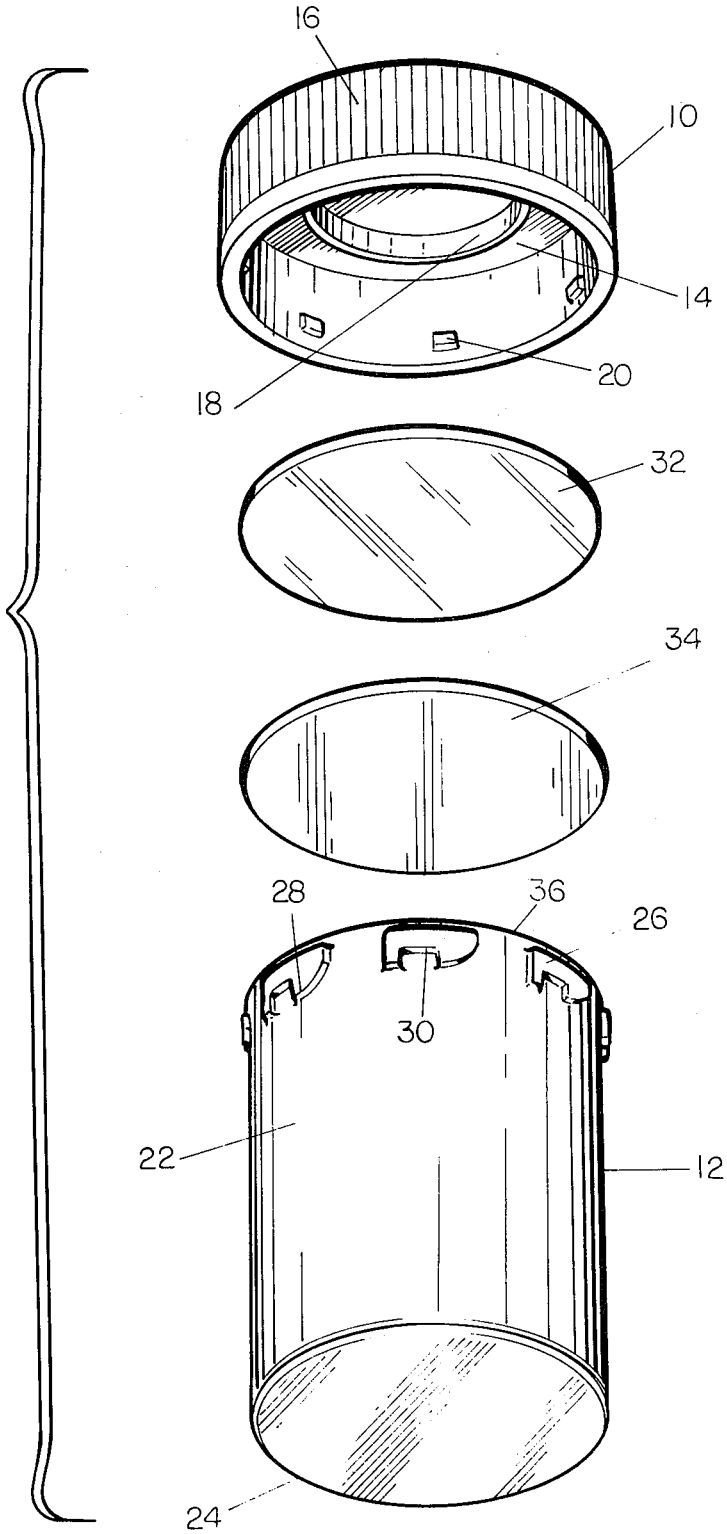
FIG. 1 is an exploded, perspective view of the component parts comprising the improved vapor-sealing, child-resistant closure and container combination of this invention.

Referring to FIG. 1, a child-resistant closure, indicated generally by the numeral 10, is illustrated as being adapted to be locked into engagement with a suitable container or vial, illustrated generally by the numeral 12. The closure 10 includes a top panel 14 and an annular skirt 16, which depends downwardly from the outer periphery of the top panel 14. The top panel 14 incorporates an annular rim or abutment 18, which is formed on the inner surface of the top panel 14 and depends downwardly therefrom. A plurality of inwardly extending lugs 20 are formed on the inner surface of, and spaced circumferentially around, the annular depending skirt 16.

The container 12 includes a cylindrical sidewall 22, which is open at the top and closed at the bottom by means of a circular bottom panel 24. A plurality of circumferentially spaced, radially extending projections 26 are formed on the upper end of the outer surface of the cylindrical sidewall 22. The projections 26 incorporate tapered cam surfaces 28, which lead into the locking notches 30. The container 12 may also comprise a blown plastic container configuration.

When it is desired to press the closure 10 into locking engagement with the container 12, it is positioned on the container so that the lugs 20 pass between the projections 26. The closure is then rotated so that the locking lugs 20 slide along the camming surface 28 until they are received within the locking notches 30. The closure 10 may then be removed from locking engagement with the container 12 by pressing downwardly to move the closure 10 in an axial direction relative to the container 12 to thereby dislodge the locking lugs 20 from the locking notches 30. The closure can then be removed from the container by rotating it sufficiently to allow the locking lugs 20 to pass between the projections 26 and then lifting the closure from the container.

A unique liner system comprised of two individual layers is provided by this invention to serve both as a spring member to hold the closure in locking engagement with the container and to provide a deformable vapor seal between the closure and the container. The liner system of this invention includes a first liner disk 32, which is formed from a flexible and resilient material to provide a spring member between the closure 10 and the container 12. The second portion of the liner system is formed from a disk 34 of highly deformable material which is positioned under the first disk 32, so as to be in contact with the upper edge 36 of the container 12.

Figure 3:
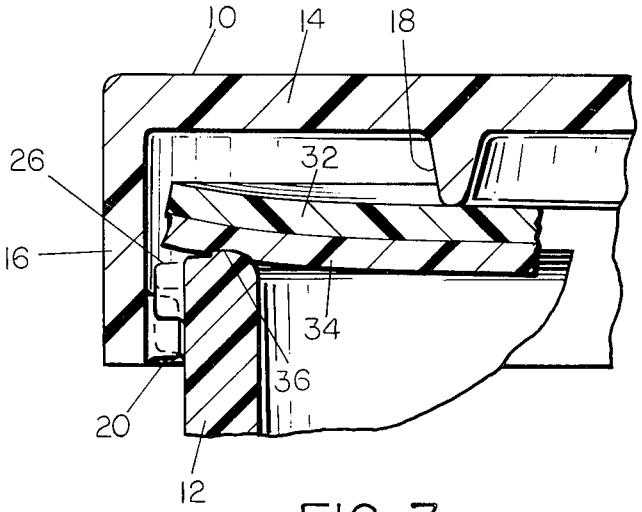
FIG. 3 is an enlarged, sectional view, similar to FIG. 2 showing the relationship of the members when the closure has been locked into engagement with the container.
Figure 2:
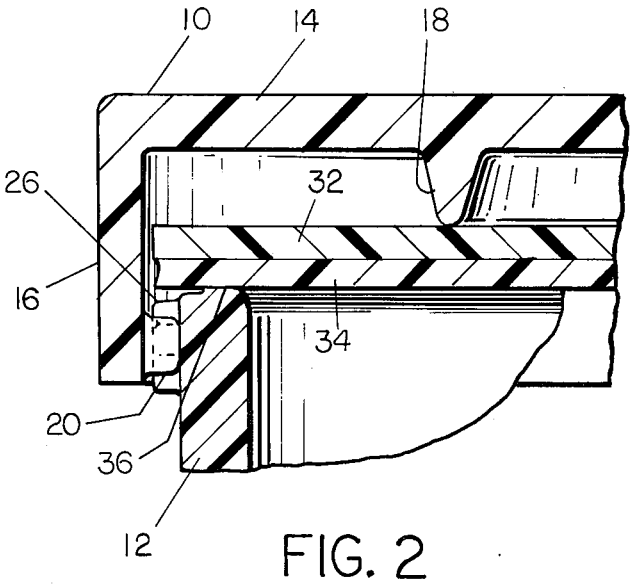
FIG. 2 is an enlarged, partial sectional view, showing the relationship between the closure and container and the two-piece, vapor-sealing liner system positioned therebetween as the closure is applied to the container.

The relationship of these members during the operation of the closure can best be seen by referring to FIGS. 2 and 3. In FIG. 2, the closure 10 has been positioned on the container 12 so that the locking lugs 20 pass between the locking projections 26 on the container. As this occurs, the annular abutment 18 on the closure contacts the upper surface of the first liner layer 32. As the closure 10 is pushed downwardly and rotated so that the locking lugs 20 ride over the camming surfaces 28 and into engagement with the locking notches 30, the annular abutment 18 and the liner layers 32 and 34 assume the position shown in FIG. 3. In this position, the upper liner layer 32, which is formed of a flexible and resilient material, performs the function of a spring member to bias the closure upwardly relative to the container to thereby maintain the locking lugs 20 in locking engagement with the notches 30. In this same position, the lower liner layer 34, which is formed of a highly deformable material, is biased into sealing engagement with the upper rim 36 of the container 12 to form a highly effective vapor seal to prevent the transmission of moisture vapor into the interior of the container. When it is desired to remove the closure from the container, a downward force must be applied to the closure against the spring action of the upper liner layer 32 so that the locking lugs 20 are moved downwardly a distance sufficient to allow them to be rotated out of the notches 30 and pass upwardly between the locking projections 26 as the closure is removed.

Thus, it can be seen from the preceding description that a unique, two-layer liner system is provided by this invention to be well suited to cooperate with a safety closure and container combination to provide both an effective spring force and a vapor seal between the closure and container. It is suggested that the liner layer 32 could be formed from a disk of low density polyethylene material having a thickness of approximately 0.030 inch. It is suggested that the deformable liner layer 34 may be formed from a 0.031 inch layer of any of several elastomeric foams, such as polyethylene foam, Voltek Volara A or Telecar 405-021 or solid materials. It has also been found that the surface of the deformable liner layer can beneficially be lubricated with substances, such as a thin coating of wax. In addition, for the sake of convenience in assembly, it has been found that the two liner layers may be laminated together.

We Claim:

1. a vapor-sealing, child-resistant closure and container combination comprising: an open-mouthed container having a plurality of circumferentially spaced projections extending radially outwardly adjacent the open end thereof, an annular rim portion on the open end thereof, said projections having a downwardly facing notch therein; a closure having a top panel and an annular skirt depending from the periphery of the top panel, a plurality of radially inwardly extending and circumferentially spaced lugs on the inner surface of said skirt, said lugs being adapted to engage the notches in the projections on the skirt of said container, an integral annular abutment formed on, and depending from, the inner surface of the top panel of said closure; and a liner sytem carried by said closure, including a first liner member formed from a flexible and resilient material interposed between the free edge of the annular abutment and the lugs on the skirt of the closure, and a second liner layer formed from a deformable material underlying said first liner layer between the free edge of the annular abutment and the lugs on the skirt of the closure; said annular abutment adapted to bias said first resilient liner layer downwardly to force said second deformable liner layer into vapor-sealing engagement with the annular rim on said container, when the lugs on said closure are engaged within the notches in the projections on the skirt of the container.

2. The vapor-sealing, child-resistant closure and container combination of claim 1, wherein said first liner layer is formed from a low density, polyethylene material.

3. The vapor-sealing, child-resistant closure and container combination of claim 1, wherein said second liner layer is formed from an elastomeric foam.

4. A moisture-vapor permeation sealing closure and container combination comprising:

an open-mouthed container, having an annular rim on the open end thereof;

a closure, having a top panel and an annular skirt depending from the periphery of the top panel adapted to sealingly close the open end of said container, said closure and container having releasable, mating locking means thereon for maintaining said closure and container in engagement with each other, said closure also including an integral annular abutment formed on, and depending from, the inner surface of the top panel of said closure; and a liner system carried by said closure, including a first liner member formed from a flexible and resilient material interposed between the free edge of the annular abutment and the locking means on the closure, and a second liner layer formed from a deformable material underlying said first liner layer between the edge of the annular abutment and the locking means on the closure; said annular abutment adapted to bias first resilient liner layer downwardly to force said second deformable liner layer into vapor-sealing engagement with the annular rim on the container when the locking means on the closure and container are in engagement.

5. The moisture-vapor permeation sealing closure and container combination of claim 4, wherein said first liner layer is formed from a low density polyethylene material.

6. The moisture-vapor permeation sealing closure and container combination of claim 4, wherein said second liner layer is formed from an elastomeric foam.

* * * * *